US005655850A

United States Patent [19]

Holmgren

[11] Patent Number: 5,655,850

[45] Date of Patent: Aug. 12, 1997

[54] FLOATING DOCK AND BOAT LIFT

[75] Inventor: Robert F. Holmgren, Wayzata, Minn.

[73] Assignee: Armada Group, Inc., Excelsior, Minn.

[21] Appl. No.: 418,792

[22] Filed: Apr. 7, 1995

Related U.S. Application Data

[63] Continuation-in-part of Ser. No. 202,458, Feb. 28, 1994, abandoned.

[51] Int. Cl.[6] ..... B63C 3/06

[52] U.S. Cl. ..... 405/3; 114/48; 405/1

[58] Field of Search ..... 405/1, 3, 4, 7, 405/218, 219, 221; 114/44–48

[56] References Cited

U.S. PATENT DOCUMENTS

| | | | |
|---|---|---|---|
| 3,169,644 | 2/1965 | Godbersen | 214/1 |
| 3,439,454 | 4/1969 | Stretton | 49/362 |
| 3,951,087 | 4/1976 | Carson | 114/45 |
| 4,505,619 | 3/1985 | Sargent | 405/220 |
| 4,645,380 | 2/1987 | Hambrick et al. | 405/220 |
| 4,686,920 | 8/1987 | Thomas | 405/3 |
| 4,787,327 | 11/1988 | Porter | 114/44 |
| 5,165,823 | 11/1992 | Cupples | 405/219 |
| 5,238,324 | 8/1993 | Dettling | 405/3 |
| 5,390,616 | 2/1995 | Roth | 405/3 |

OTHER PUBLICATIONS

"The Sidewinder" from Keibler Technologies.

"Floating Water–Free Boat Lift" from Water Free Docks, Inc.

"Alum–A–Vator" from Quality Boat Lifts, Inc.

"Hydrohoist" from Hydrohoist Boat Lifts.

"DLC–Floating Dock, Lift, and Capopy" from Shoremaster.

"Econo–Lift Boat Hoist" from Econo–Lift Boat Hoist.

"Harber Hoist" from Hydrohorist International Inc.

*Primary Examiner*—Dennis L. Taylor

*Attorney, Agent, or Firm*—Jacobson & Johnson

[57] ABSTRACT

A floating boat lift having 2 side support frames and a front frame with a central region for docking a boat therein with flotation devices attached to the side support frames, flotation devices having sufficient flotation to floatingly suspend the boat lift and a boat carried entirely by the boat lift in a body of water without the aid of lake-bed supports for the boat lift or the boat and a boat lift mechanism carried by the support frames, the boat lift mechanism having U-shaped members with a first side being carried by the first side frame and with a second side carried by the second side frame with a boat lift bar located in a vertically sliding relationship in a first portion of the U-shaped members proximate the first side frame and a second end located in a vertically sliding relationship in another portion of the U-shaped members located proximate the second side dock. A cable-lift system mounted in the boat lift permits raising the lift bar while the ends of the lift bars are guided and restrained by guide slots in the U-shaped members so that a boat located on the lift bars can be lifted and suspended above the water by the floating boat lift.

12 Claims, 5 Drawing Sheets

FLOATING DOCK AND BOAT LIFT

CROSS REFERENCE TO RELATED APPLICATIONS

This application is a continuation-in-part of my U.S. patent application Ser. No. 08/202,458 filed Feb. 28, 1994 titled Floating Dock and Boat Lift, now abandoned.

FIELD OF THE INVENTION

This invention relates generally to boat boat lifts and, more specifically, to a floating boat lift with a lifting device having a boat lift for engagement with a boat to permit an operator to partially raise a boat to move the boat lift and the boat from a launching area to a mooring area and to then raise the boat out of the water with or without the aid of lake bed supports.

BACKGROUND OF THE INVENTION

The concepts of boat lifts are well known in the art. In one type of boat lift, the boat lift mechanism is mounted directly on the lake bed and a mechanical device is used to raise or lower the boat. In another type, the boat lift mechanism uses tanks to raise or lower the boat pneumatically. In U.S. Pat. No. 3,951,087 the tanks are filled with water to lower the frame that supports a boat and am filled with air to elevate a boat out of the water. Still other types of boat lift mechanisms use a mechanical cantilever-type of lift which mechanically lifts the boat out of the water. In general, prior art U.S. Pat. No. 5,238,324 points out that floating boat docks don't have the stability to support a boat raised above water. Contrary to the above patent, the present invention with side support frames provides a self-contained, improved, completely stable floating boat lift where the support frame and boat lift is supported by flotation devices located on the bottom of the frame that provide safety and reliability not found in other prior art units. The boat lift mechanism is attached to the inside portion of parallel spaced side frames to provide a support structure that enables the transfer of both the weight of the boat and lift to the side frames. The attachment of the boat lift mechanism to both of the side frames provides torsional stability to prevent twisting of the docks as the boat is suspended above the water. In addition, the boat lift mechanism permits engagement with the bottom of the boat to enable a boat operator to transfer a portion of the weight of the boat onto the boat lift so the operator can propel the boat, and the boat lift to a remote location by partially elevating the boat on the floating lift to bring the bottom of the boat into frictional engagement with the lift bars on the boat lift mechanism. When the boat and boat lift arrive at the remote location, the lift raises the boat out of the water.

SUMMARY OF THE INVENTION

A boat lift having a central region for lifting and lowering a boat therein with flotation devices floatingly supporting the boat lift. The flotation devices having sufficient solid rectangularly shaped flotation to buoyantly suspend the boat lift and a boat in a body of water without the aid of lake bed supports for either the boat lift or the boat. A boat lift mechanism is carried inside the central region by the side support frames having a U-shaped member with a first side being carried by a first side frame and with a second side carried by a second side frame with a boat lift bar located in a vertically sliding relationship in a first potion of the U-shaped member proximate the first side frame and a second end located in a vertically sliding relationship in another portion of the U-shaped member located proximate the second side dock. A partially concealed cable system mounted in the decked frame permits partial or full raising of the lift bars while the ends of the lift bars are guided and restrained by the edges of an H-shaped channel used to form the U-shaped members. A boat located on the lift bars can be lifted and suspended in or above the water by the boat lift. If the boat is partially suspended in the water the boat can be used to move the boat lift from a launching area to a remote mooring area. A reversible electric motor rotates a rotatable threaded member to raise or lower the boat lift bars.

DESCRIPTION OF THE PREFERRED EMBODIMENT

Figure 1:
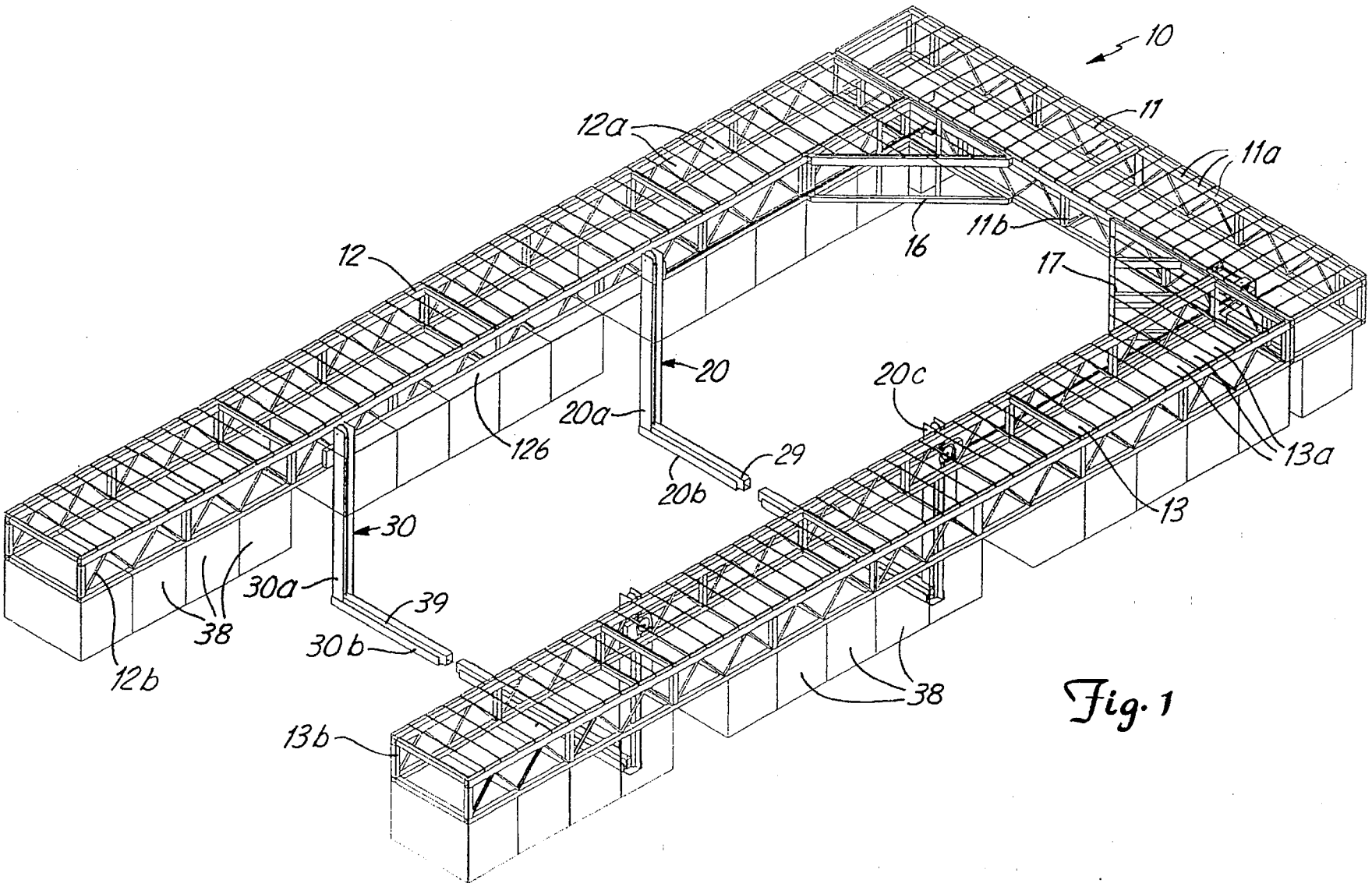
FIG. 1 shows a perspective view of my floating boat lift.

FIG. 1 reference numeral 10 generally identifies my boat lift comprising a front frame 11, a first side frame 12 and a second side frame 13. A first brace 16 connects side frame 12 to front frame 11 and a second brace 17 connects front frame 11 to side frame 13 to hold front frame 11, first side flame 12 and second side frame 13 in a unitary formed boat lift having a central region for lifting or lowering a boat. A series of planks or deck boards 11*a*, 12*a* and 13*a* form a horizontal surface on which a person can walk. A rigid support structure 12*b* provides support for side frame 12. Similarly, a rigid support structure 13*b* provides support for side frame 13. A similar rigid support 11*b* supports front frame 11. Front frame 11 has one end connected to side dock frame 12*b* and the other end connected to side frame 13*b* to provide a support frame with sufficient integrity so that the side frames and front frame form a unified or unitary-like construction. A boat lift mechanism includes cross members 20*b* and 30*b* which not only provide a platform base for a boat, but stability for the side frames. A plurality of flotation devices 38 support side frame 12 and side frame 13 with the flotation devices having sufficient flotation to not only suspend the boat lift but a boat carried by a boat lift mechanism attached to side frame 12 and side frame 13. Preferably, flotation devices are box-like in shape and have a solid foam core to provide all-weather performance to be viable even if allowed to remain in the water when the lake freezes.

Figure 4:
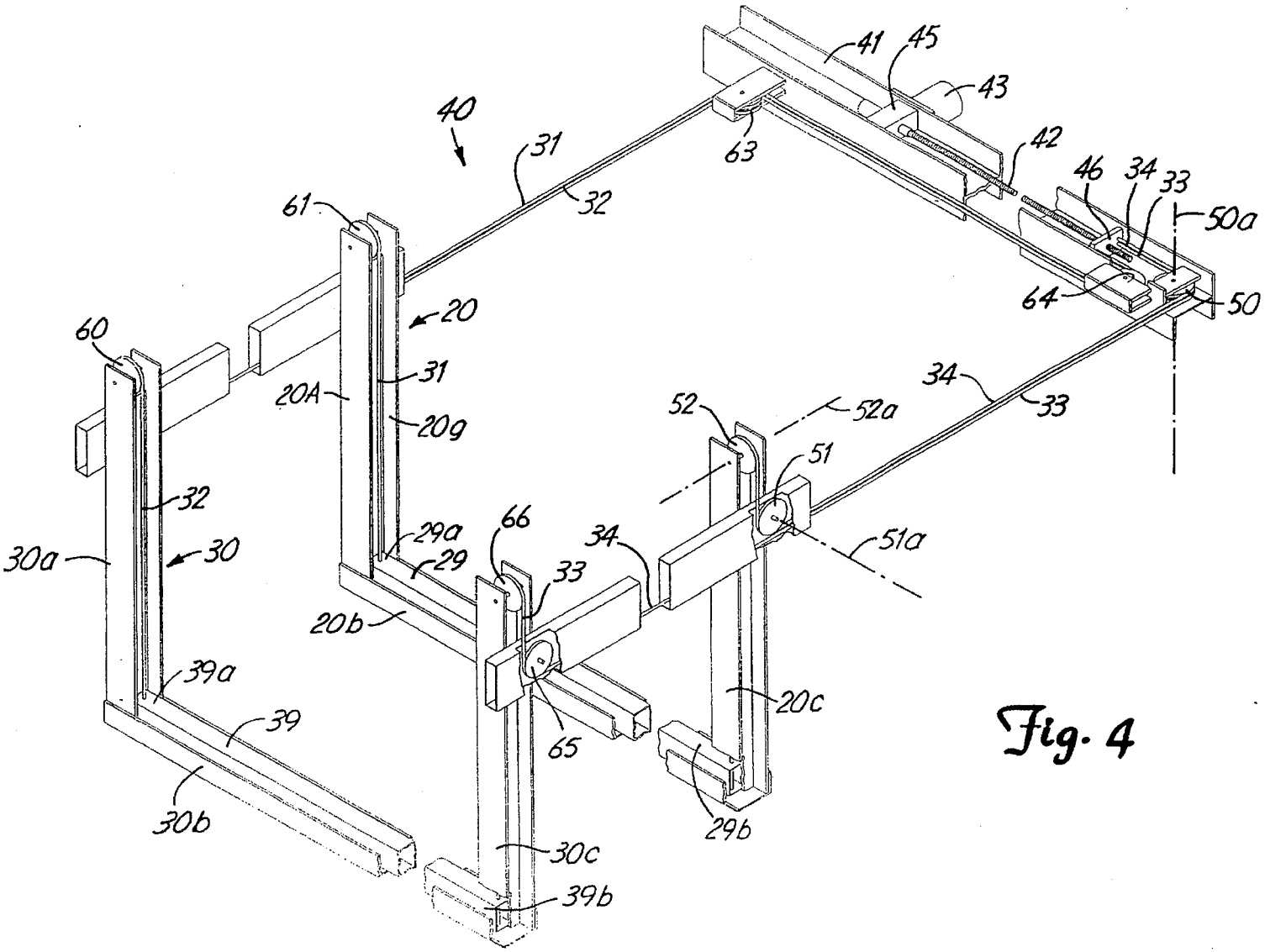
FIG. 4 shows the cable system for raising and lowering boats located in my floating boat lift.

FIG. 4 shows a boat lift mechanism or a cable-lift system 40 isolated from the support frames. FIG. 1 shows cable-lift system 40 attached to the side frames. Cable-lift system 40 is substantially hidden within the confines of the frames 11, 12 and 13 to produce a boat lift free of obstructions that can interfere with access to and from a boat located in the boat lift.

Cable system 40 includes a first U-shaped member 20 having a vertical guide member 20*a* attached to and supported by side frame 12*b* (FIG. 1). U-shaped member 20 has a second vertical guide member 20*c* connected to and supported by side frame 13*b* (FIG. 1). FIG. 4 shows vertical guide member 20*a* with a guide slot 20*g* to enable the end 29*a* of lift bar 29 to slide up and down therein. A cross channel 20*b* connects member 20*a* to member 20*c* to form a brace and spacer to help maintain the side docks 12 and 13 in a spaced parallel relationship. Cross channel 20*b* includes a recess for receiving and holding a lift bar 29. The end 29*a* of lift bar 29 is located in a vertically slideable relationship within side guide member 20*a* and similarly end 29*b* is located in a vertically slideable relationship within side guide member 20*c* to ensure that lift bar 29 moves vertically upward or downward without swaying from side to side.

Similarly, a second U-shaped member 30 having a vertical guide member 30*a* attached to and supported by side frame 12*b* (FIG. 1). U-shaped member 30 has a second vertical guide member 30*c* connected to and supported by side frame 13*b* (FIG. 1). A cross channel 30*b* connects member 30*a* to member 30*c* to form a brace and spacer to help maintain the side flames 12 and 13 in a spaced parallel relationship. Cross channel 30*b* includes a recess for receiving and holding a second lift bar 39. The end 39*a* of lift bar 39 is located in a vertically slideable relationship within side guide members 30*a* and, similarly, end 39*b* is located in a vertically slideable relationship within side guide member 30*c* to ensure that lift bar 39 moves vertically upward or downward without swaying from side to side.

Cable-lift system 40 mounts directly to and is partially supported by side frame 12*b* and partiality supported by side frame 13*b*. A cross channel having a shape of an H-beam is located in and secured to front frame 11. A set of cables 31, 32, 33 and 34 connect lift bars 29 and 39 to cross channel 41 which is located under deck planks 11*a* on front frame 11. Cable-lift system 40 is secured to the inside portion of side frame 12*b*, to the inside portion of side frame 13*b* and to the inside portion of front dock frame 11*b* through means (not shown) to maintain the cable-lift system in the orientation and position as illustrated in FIG. 4.

Cross channel 41 comprises an H-shaped-beam member with a grooved sheave 50 located on one end to support cables 33 and 34. Sheave 50 has an axis of rotation identified by reference numeral 50*a*. One end of cable 33 and one end of cable 34 fits into and is held by a cable plate or equalizer plate 46. Similarly, one end of cable 31 and one end of cable 32 fit into and are held by the opposite end of cable plate or equalizer plate 46. In one embodiment, cable plate 46 has a threaded opening located midway between the ends of cable plate 46 with a rotatable threaded member 42 located in threaded engagement with cable plate 46. Rotatable threaded member 42 is rotatably supported by a screw actuator 45 mounted in channel 41. In another embodiment cable plate 46 is belted to a flange midway between the ends of cable plate 46 with rotatable threaded member 42 flanged to plate 46.

In one embodiment, a worm drive (not shown), such as a ball screw actuator which is driven by an electric motor 43, rotates member 42 to raise or lower the boat. The motor includes a lock mechanism (not shown) to ensure that the boat lift will not accidentally move up or down.

Similarly, FIG. 4 shows one end of cable 31 connects to lift bar 29 and the other end to cable plate 46 through a first sheave 61, a second sheave (not shown), a third sheave 63 and a fourth sheave 64. FIG. 4 also shows that one end of cable 32 connects to lift bar 39 and the other end to cable plate 46 through a first sheave 60, a second sheave (not shown), third sheave 63 and fourth sheave 64.

On the opposite side, one end of cable 33 connects to lift bar 39 and the other end to cable plate 46 through a first sheave 66, a second sheave 65 and a third sheave 50. Similarly, one end of cable 34 connects to lift bar 29 and the other end to cable plate 46 through a first sheave 52, a second sheave 51 and third sheave 50. Sheave 51 has a central rotation axis 51*a*, sheave 52 has a central rotation axis 52*a* and sheave 50 has a central rotation axis 50*a* with each of the axes located in mutually perpendicular relationship to enable the vertical lifting motion of the cable to be transferred to horizontal motion in one direction and then horizontal motion in a second direction.

Thus, all four cables are held by a single common cable plate 46 which is slideable within channel 41 through operation of electric motor 43. That is, operating electric motor 43 causes rotatable member 42 to rotate within screw actuator 45 so that cable plate 46 is brought closer to or farther away from the screw actuator 45. Moving cable plate 46 closer to screw actuator 45 simultaneously raises lift bars 29 and 39 vertically upward with the ends of lift bars being guided and retained by the channels located in the side members. Likewise, moving cable plate 46 further away from screw actuator 45 simultaneously lowers lift bars 29 and 39. The vertical channels 30*a*, 30*c*, 20*a* and 20*c* provide vertical guides for the lift bars, as well as providing a cross-brace between the two side frames. If electric power is unavailable, a hand crank (not shown) can be used to rotate member 42 to manually raise or lower lift bars 29 and 39.

Figure 5:
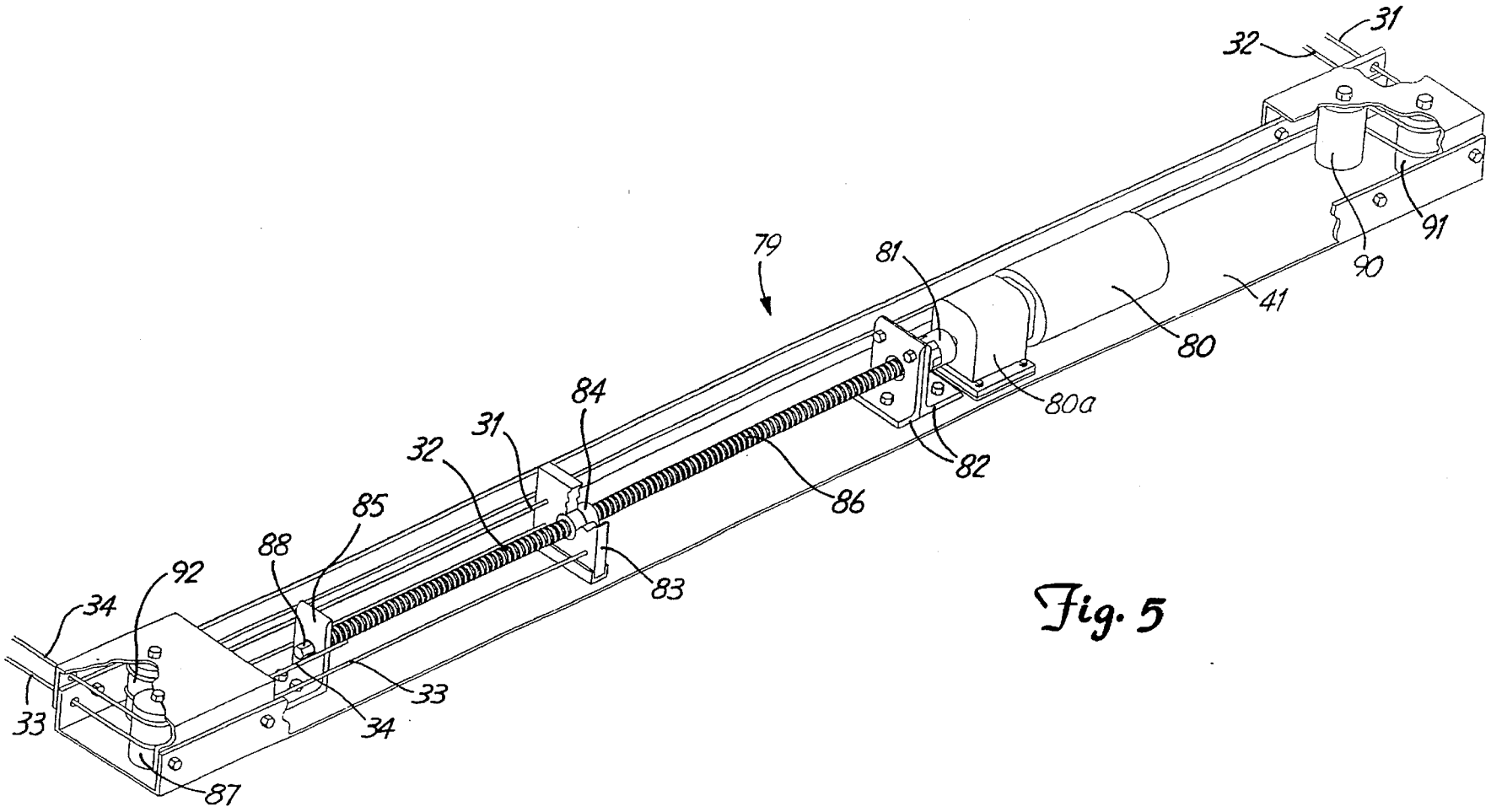
FIG. 5 shows a perspective view of an alternate power mechanism for raising and lowering a boat positioned in my floating boat lift.

FIG. 5 shows an alternate embodiment of the concealed power mechanism 79 for raising and lifting a boat. Cables 33 and 34 are shown entering one end of power channel housing 41 and cables 31 and 32 are shown entering the opposite end of power channel housing 41. Cables 31 and 32 pass around rollers 90, 91 and 92 before being fastened to slidable equalizer or cable plate 83. Similar cables 33 and 34 pass around roller 87 before engaging cable plate 83. Cable plate 83 includes a threaded member 84 that is integrally connected to cable plate 83. Located on the bottom of cable plate 83 is a plastic shoe to permit cable plate 83 to slide along the bottom of channel 41. Channel 41 coacts with cable plate 83 to prevent rotation of cable plate 83 in channel 41 but permits axial displacement of cable plate 83 along channel 41. Power mechanism 79 includes an electric motor 80 connected to a small "J" gear 80*a* which has a thrust coupler bearing 81 extending therefrom joining the screw and the gear motor shaft. A pair of fight angle brackets 82 are fixedly mounted on frame 41 providing a mounting for the thrust bearing that engages the coupler face and carries the load of the boat hoist. A rotatable threaded member or screw drive member 86 extends lengthwise along channel 41 with one end of rotatable threaded member 86 rotatably supported in bracket 85. The end of rotatable threaded member includes a hex head 88 for engagement with a socket wrench. Normally, rotatable threaded member 86 is powered by gear motor 80 which rotates rotatable threaded member 86 in one direction to lower the boat and boat lift, and the opposite direction to raise the boat and boat lift.

In operation of the power mechanism rotatable threaded member 86 is rotated while thrust bearing 81 engages bracket 82. Rotation of rotatable threaded member 86 in a first direction causes cable plate 83 to be driven axially along channel 41 and toward bracket 82. As cable plate 83 is moved along channel 41 it pulls equally on cables 33, 34, 31, and 32 to raise the boat supported by the boat lift members. Similarly, when rotatable threaded member 86 is rotated in the opposite direction cable plate 83 moves axially toward end bracket 85 which causes cables 33, 34, 31 and 32 to retract thus lowering the beat supported by the boat lift members.

Figure 2:
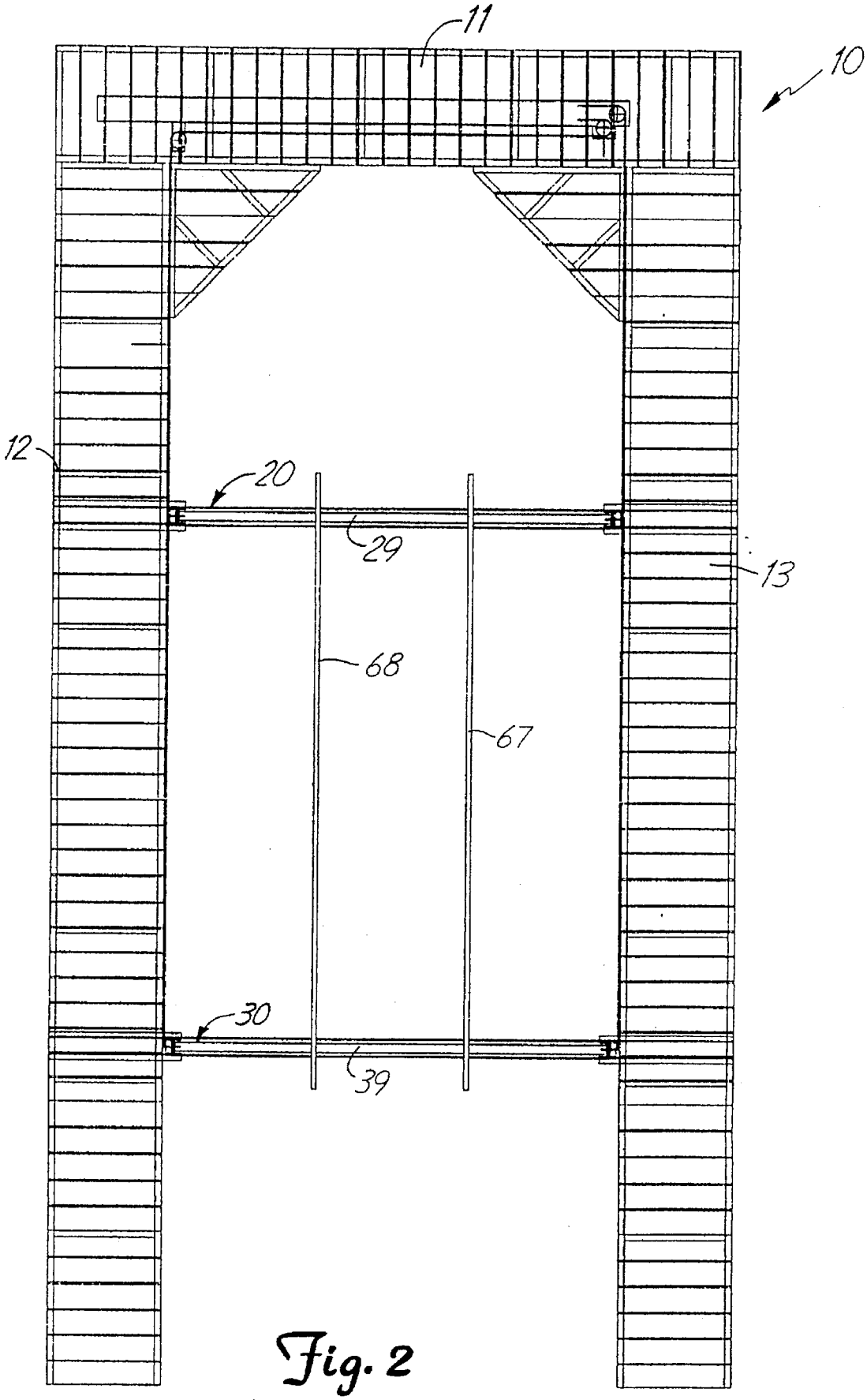
FIG. 2 shows a top view of an alternate embodiment of the floating boat lift of FIG. 1.

FIG. 2 shows an alternate embodiment of FIG. 1 which is identical to the embodiment shown in FIG. 1 except that a first runner 67 and a second runner 68 extend from lift bar 29 on first U-shaped member 20 to lift bar 39 on second U-shaped member 30. This type of arrangement is suitable for boats which may have a V-bottom.

Figure 3:
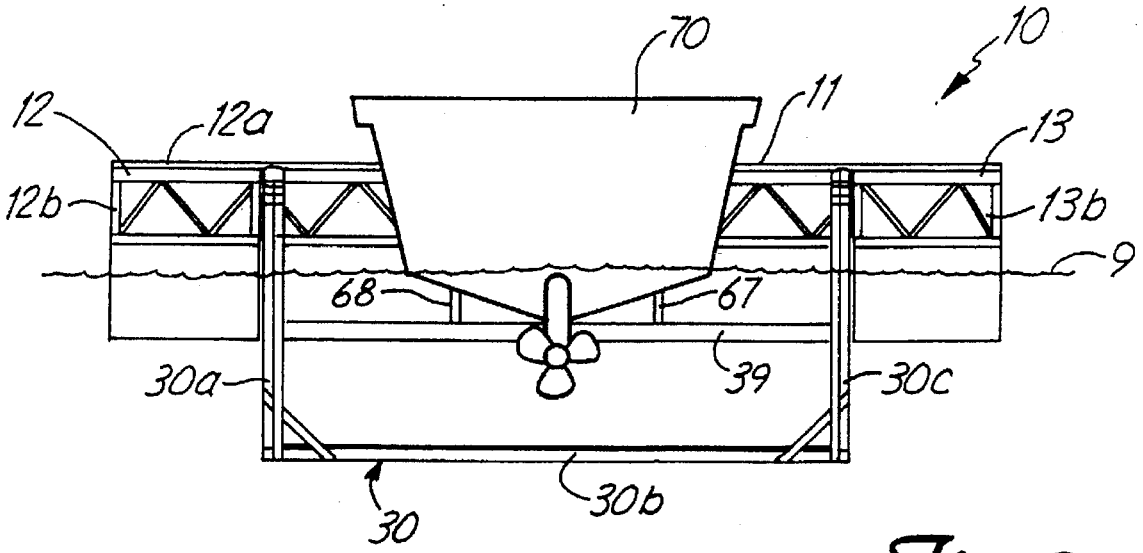
FIG. 3 shows an end view of the floating boat lift of FIG. 2.

FIG. 3 shows an end view of dock 10 with a boat 70 mounted in the floating boat lift with runners 67 and 68 supporting boat 70 partially out of water 9. In this condition, lift bar 39 is spaced upward and away from bottom member 30*b* of U-shaped member 30. By lifting the boat partially out of the water, part of the weight of the boat is placed on the side support flames. This enables the boat lift to become portable. That is, the upward buoyancy forces from the side support frames engage the bottom of the boat and hold the lift mechanism and boat as a unit. Engagement of the boat lift with the boat enables an operator to use the motor of the boat to propel the boat as well as the floating boat lift from a launching area to a location for mooring or installation. This is convenient for situations in which the boat lift must be located by a shore where there is no access for getting the boat lift into or out of the water. Consequently, the user can take the floating boat lift to a remote boat launching ramp, float the boat lift into the water, drive the boat into the central region of the frame structure and partially lift the boat to engage the floating boat lift with the boat. The operator can drive the boat with the boat lift to a remote location where the boat lift can then be anchored or tied to a shore side bulkhead or pier.

FIG. 3 illustrates lift bar 39 forming a horizontal cross brace and spacer between side frame 12 and side frame 13 to help maintain the side frames in a spaced relationship as the lift bar is raised.

If desired, wheels can be placed on U-shaped member 30 and U-shaped member 20 to allow dock 10 to be moved about over the ground once the dock is moved out of the water. In an alternate embodiment, wheels can be placed on support beams connected to and supporting opposite sides of support members 20*b* and 30*b*. (FIG. 4)

While two lift bars are shown only one lift bar may be needed if the lift bar contains a cradle or support for the boat. In addition, if desired one may place comer braces on members 20 and 30 to provide greater stability for the lift bars.

I claim:

1. A floating boat lift comprising:

a boat lift mechanism located on said floating boat lift;

a power mechanism including a power channel housing mounted on the floating boat lift;

a motor;

a threaded member mounted to said motor, said threaded member rotatively driveable by said motor;

a cable plate slideable mounted in said power channel housing;

a front frame having a first end and a second end;

a first side frame connected to said first end of said front frame;

a second side frame connected to said second end of said front frame with said front frame and said side frames forming a central region for lifting and lowering a boat therein;

flotation devices attached to side frames, said flotation devices having sufficient flotation to floatingly suspend said floating boat lift and a boat carried entirely by said boat lift in a body of water without the aid of lake-bed supports for the boat lift or the boat;

the boat lift mechanism carried by said side frames, said boat lift mechanism having a U-shaped member having a first side being carried by said first side frame and a second side carried by said second side frame; said U-shaped member having a boat lift bar extending from a first side of said U-shaped member to a second side of said U-shaped channel, said boat lift bar having a first end and a second end with said lift bar first end located in a vertically sliding relationship in a portion of said U-shaped member proximate said first side frame and a second end located in a vertically sliding relationship in another portion of said U-shaped member located proximate said second side frame with said U-shaped member providing stability to maintain said side frames in a spaced apart position;

a cable system secured to said front frame and said side frames, said cable system operable for raising said lift bar while said ends of said lift bar are guided and restrained by said U-shaped member so that a boat located on said lift bar can be lifted and suspended above the water by the floating boat lift by rotation of said threaded member in a first direction to move the cable plate axially along the housing in a first direction to lower the boat lift bars and the rotation of said threaded member in the opposite direct to move the cable plate axially in the opposite direction to raise the boat lift bars.

2. The floating boat lift of claim 1 including a second U-shaped member having a first side being carried by said first side frame and a second side carried by said second side frame; said second U-shaped member having a boat lift bar extending from a first side of said U-shaped member to a second side of said U-shaped channel, said boat lift bar second U-shaped member having a first end located in a vertically sliding relationship in a portion of said U-shaped member proximate said first side frame and a second end located in a vertically sliding relationship in another portion of said U-shaped member located proximate said second side frame so that said cable system can simultaneously lift said boat lift bar of said first U-shaped member and said boat lift bar of said second U-shaped member.

3. The floating boat lift of claim 2 including a pair of runners extending from said first boat lift bar to said second boat lift bar for engagement with the bottom of a boat located thereon.

4. The floating boat lift of claim 1 wherein the power mechanism powering said cable system is located in a concealed condition in the floating boat lift.

5. The floating boat lift of claim 3 wherein said first U-shaped member and said second U-shaped member form braces for maintaining said first side dock and said second side dock in a spaced condition.

6. The floating boat lift of claim 5 wherein said cable system includes a first cable having a first end connected to one end of said first lift bar and a second end connected to said cable plate, and a second cable connected to the other end of said lift bar and to said cable plate.

7. The floating boat lift of claim 6 having a threaded opening located therein to permit rotation of said threaded member to raise said first lift bar when rotated in a first direction and to lower said first lift bar when rotated in second direction opposite said first direction.

8. The floating boat lift of claim 7 wherein the motor comprises a reversible electric motor for rotating said rotatable threaded member.

9. The floating boat lift of claim 8 including at least three sheaves supporting said first cable with said sheaves each having an axis of rotation located in a mutually perpendicular orientation to thereby transfer a vertical lifting motion to a horizontal and transverse motion.

10. A floating boat lift including:

a power mechanism;

a power channel housing mounted on the floating boat lift;

a motor;

a threaded member mounted to said motor, said threaded member rotatively driveable by said motor;

a cable system secured to said floating boat lift, said cable system operable for raising and lowering a boat located on said floating boat lift;

a cable plate slideable mounted in said power channel housing, said cable plate carrying a cable in tension so that rotation of said rotatable threaded member in a first direction moves the cable plate axially along the housing in a first direction to retract the cable and the rotation of said rotatable threaded member in the opposite direct moves the cable plate axially in the opposite direction to extend the cable;

a boat lift mechanism located on said floating boat lift; and a head on said threaded member to permit rotation of said threaded member with a wrench if power should not be available to raise and lower the boat lift mechanism.

11. The floating boat lift of claim 1 wherein said motor for rotating said rotatable threaded member is located in said power channel housing.

12. A boat lift comprising:

a frame for lifting a boat;

a power mechanism including a thrust bearing;

a power channel housing;

a motor;

a threaded member mounted to said motor, said threaded member rotatively driveable by said motor;

a cable system secured to said boat lift, said cable system operable for raising and lowering a boat located on said boat lift; and a cable plate slideable mounted in said power channel housing, said cable plate carrying a cable in tension so that rotation of said rotatable threaded member in a first direction moves the cable plate axially along the housing in a first direction to retract the cable and the rotation of said rotatable threaded member in the opposite direct moves the cable plate axially in the opposite direction to extend the cable and wherein said cable plate includes a shoe.

* * * * *